US006938759B2

(12) United States Patent
Golden et al.

(10) Patent No.: US 6,938,759 B2
(45) Date of Patent: Sep. 6, 2005

(54) PACKAGE FOR STORING DISCS

(75) Inventors: Ken Golden, Morris Plains, NJ (US); Andrew Napolitane, New York, NY (US)

(73) Assignee: Tri-Plex Packaging Corporation, New York, NY (US)

( * ) Notice: Subject to any disclaimer, the term of this patent is extended or adjusted under 35 U.S.C. 154(b) by 205 days.

(21) Appl. No.: 10/323,487

(22) Filed: Dec. 19, 2002

(65) Prior Publication Data

US 2004/0118714 A1 Jun. 24, 2004

(51) Int. Cl.[7] ..... B65D 85/30
(52) U.S. Cl. ..... 206/308.3; 206/308.1
(58) Field of Search ..... 206/308.1, 308.3, 206/311, 312, 313, 232; 229/72

(56) References Cited

U.S. PATENT DOCUMENTS 4,700,833 A * 10/1987 Smith ..... 206/380
5,199,743 A * 4/1993 Rosinski, III ..... 281/45
5,318,222 A * 6/1994 Bartlett ..... 229/72
5,836,507 A * 11/1998 Mueller et al. ..... 229/67.1
6,016,907 A * 1/2000 Dreier ..... 206/232
6,059,101 A * 5/2000 Gambardella et al. ... 206/308.1
6,298,985 B1 * 10/2001 Mathias ..... 206/308.1
6,845,865 B2 * 1/2005 Wynalda et al. ..... 206/308.1
2001/0037951 A1 * 11/2001 Garnier ..... 206/308.1
2003/0111368 A1 * 6/2003 Wynalda et al. ..... 206/312
2004/0069661 A1 * 4/2004 Telleen ..... 206/232

FOREIGN PATENT DOCUMENTS

GB 2275891 * 9/1994

* cited by examiner

*Primary Examiner*—Mickey Yu
*Assistant Examiner*—Faye Francis
(74) *Attorney, Agent, or Firm*—Watov & Kipnes, P.C.

(57) ABSTRACT

A package for storing discs includes at least one section having a first panel and a second panel together forming a dual disc storage area, the first and second panels each including at least one disc receiving opening in communication with the dual disc storage area, the dual disc storage area having a first storage space between the second panel and an intermediate panel integral with the second panel at one end, and a second storage space formed between the first and a portion of the intermediate panel, the intermediate panel having a lower portion with a slot therein defined by a flap covering a portion of the disc when the disc is positioned in the slot.

11 Claims, 5 Drawing Sheets

PACKAGE FOR STORING DISCS

FIELD OF THE INVENTION

The present invention relates to a package, and more particularly to a package for storing one or more discs in which at least one section of the package includes back-to-back panels enabling discs to be stored in a back-to-back relationship.

BACKGROUND OF THE INVENTION

Removable data storage media including floppy discs and the like, are used for recording and playing back data such as audio-, video- and computer-related or machine-readable data. Recent advances in technology have dramatically increased their data storage capacity, while reducing their overall physical dimensions and weight. Optical discs are one type of data storage media which utilize optical technology for managing and storing data. Optical discs are available in several formats including, but not limited to, minidiscs, compact discs ("CDs), digital video discs ("DVDs") and the like. Their large data storage capacity and compact size have made optical discs highly preferred over other types of data storage media including magnetic recording tape. The performance of these optical discs, however, can be adversely affected by minor distortions in the disc surface caused by abrasions, debris, cracks and the like. Such distortions can cause data loss or degradation in the affected optical disc.

To minimize data loss and physical damage, optical discs are typically packaged in rigid plastic containers or boxes. However, such containers are usually bulky, heavy and prone to breakage. Other optical discs are packaged in flimsy paper sleeves that provide little or no protection against physical damage from impact or stress, or must be placed into bulky packaging made from stiff paper or paperboard in order to reinforce the packaging.

Accordingly, there is a need for a package that can provide convenient and economical storage and display of discs such as optical data storage media (e.g., compact discs ("CDs"), minidiscs, digital video discs ("DVDs")) and the like, and that can be easily formed from a unitary blank, preferably from a rigid, foldable material. There is a further need for a package for storing discs, having enhanced disc storing capacity with improved weight, volume and cost savings. There is a further need for a package for storing discs that is more efficient and friendly to the environment and which has the capability of storing the discs in back to back relationship for enhanced functionality.

SUMMARY OF THE INVENTION

The present invention is directed generally to a package for storing at least one disc. The package of the present invention is convenient and inexpensive to make and use, while providing convenient packaging and display, and enhanced disc storing capacity. The present package may be operatively implemented into a compact form for efficient carrying or storage, or into an open form for providing an attractive display or retrieval of the discs packaged therein. The present package may be conveniently fabricated from a unitary blank composed of a rigid and foldable material such as paperboard. The package of the present invention is further constructed in a manner that makes it especially suitable for use in consumer packaging.

In one particular aspect of the present invention, there is provided a package for storing discs, which comprises:

at least one section comprising a first panel and a second panel together forming a dual disc storage area, the first and second panels each optionally including at least one disc receiving opening in communication with the dual disc storage area, the dual disc storage area comprising a first storage space between the second panel and an intermediate panel integral with the second panel at one end, and a second storage space formed between the first and a portion of the intermediate panel, the intermediate panel having a lower portion with a slot therein defined by a flap covering a portion of the disc when the disc is positioned in the slot.

In another particular aspect of the present invention, there is provided a package for storing discs, which comprises:

a plurality of sections operatively engaged to one another, each of the plurality of sections comprising a first panel and a second panel together forming a dual disc storage area, the first and second panels each optionally including at least one disc receiving opening in communication with the dual disc storage area, the dual disc storage area comprising a first storage space between the second panel and an intermediate panel integral with the second panel at one end, and a second storage space formed between the first and a portion of the intermediate panel, the intermediate panel having a lower portion with a slot therein defined by a flap covering a portion of the disc when the disc is positioned in the slot.

In another particular aspect of the present invention, there is provided a blank for forming a package for storing discs, which comprises:

at least one central panel optionally including a first opening;

a first side panel foldably attached to an edge of the at least one central panel, the first side panel including a second opening; and a second side panel foldably attached to an opposed edge of the at least one central panel from the first side panel, the second side panel including a frangible score line for forming a flap.

BRIEF DESCRIPTION OF THE DRAWINGS

The following drawings in which like reference characters indicate like parts are illustrative of embodiments of the invention and are not to be construed as limiting the invention as encompassed by the claims forming part of the application.

DETAILED DESCRIPTION OF THE INVENTION

Figure 1:
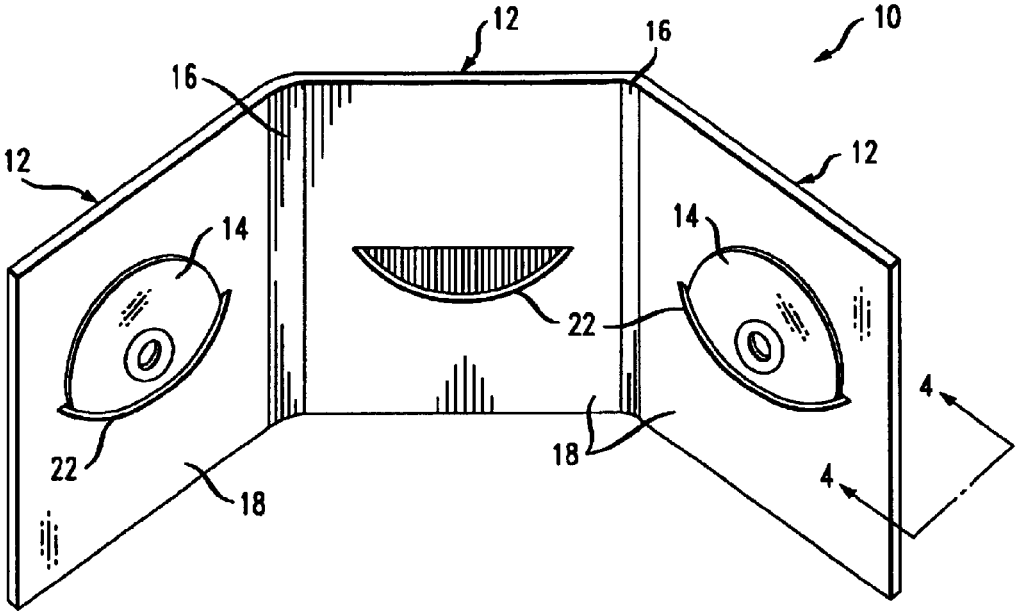
FIG. 1 is a front perspective view of a package having three disc holding sections for one embodiment of the present invention.

The present invention is generally directed to a package which can be used to accommodate one or more discs for convenient storage and display. The package of the present invention is constructed with the advantage of improved durability and enhanced disc holding capacity, while possessing minimal component parts and packaging material. The package of the present invention is adapted to protect the discs stored therein from damage such as by heat, chemicals, abrasions, contact with potentially damaging materials and the like. In addition, the package of the present invention may also be constructed in a manner which allows the user to manipulate the present package into a compact form required for convenient use, or into an open form to provide an attractive display or enable ready access to the discs contained therein. The cost effective and efficient manner by which these units are constructed and by which the package of the present invention can be used for packaging and storing discs including optical storage media (e.g. compact discs ("CDs"), minidiscs, digital video discs ("DVDs") and the like, makes them especially suitable for consumer packaging use.

In accordance with one aspect of the present invention, the package generally comprises at least one section comprising a first panel, a second panel in operatively engagement with the first panel, and a disc holding space between the first and second panels, the space adapted for reversibly receiving at least a portion of the at least one disc, and select ones of the first and second panels comprising a first opening and a second opening, respectively, in communication with the space, the first and second openings each being adapted for reversibly inserting at least a portion of a disc into the space.

The package of the present invention may be configured to include a single section designed to accommodate at least one disc, or two or more sections that may be foldably connected to one another in a suitable manner to accommodate a desired number of discs. The package of the present invention may further include additional sections which may comprise single disc holding capacity. The package of the present invention may be fabricated from a unitary blank formed from a rigid, foldable and resilient sheet material including, but not limited, to paperboard.

In a preferred embodiment, the package of the present invention may further include an intermediate panel partitioning the disc holding space defined between the first and second panels to enhance the structural strength and disc holding capacity of the section and minimize contact between the discs inserted through the first and second openings, respectively.

In a further preferred embodiment of the present invention, the intermediate panel may include a flap portion secured to an inside surface of the first panel to yield a disc passing slot in communication with the opening of the first panel. The slot is adapted for reversibly inserting therethrough at least a portion of the disc extending through the first opening and permitting the disc to be securely seated within the disc holding space as will be further described hereinafter.

Figure 2:
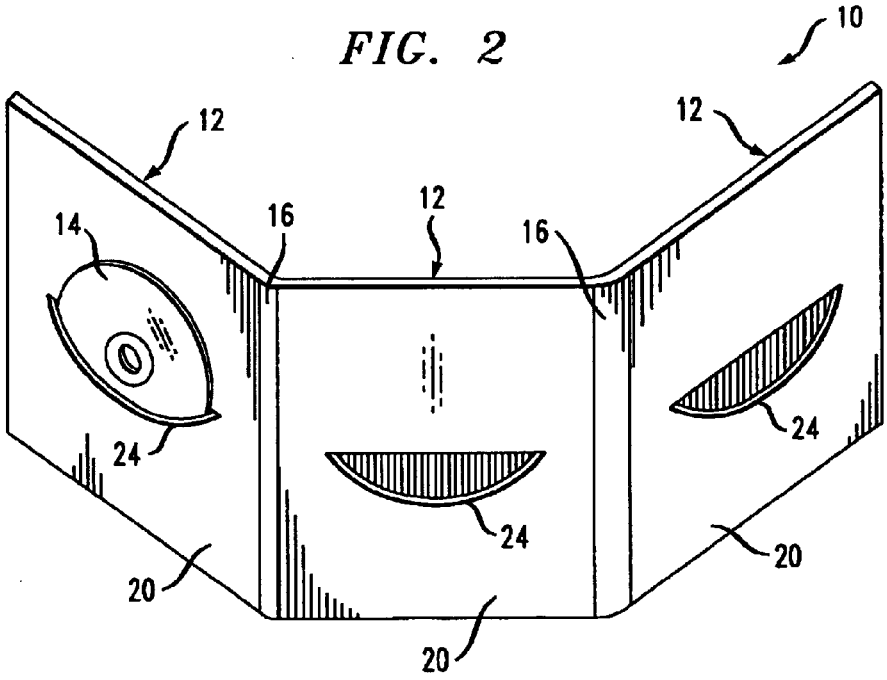
FIG. 2 is a rear perspective view of the package of FIG. 1.

Referring to FIGS. 1 and 2, a package 10 for storing one or more discs is shown for one embodiment of the present invention. The package 10 comprises three disc holding sections 12 each adapted to hold at least one disc 14, and each foldably connected to an adjacent section by a portion 16, preferably hingedly connected, to yield an arrangement in which adjacent sections 12 may be folded upon one another. Each disc holding section 12 of the package 10 includes front and rear sides. The front and rear sides may each be adapted to hold a disc 14, thereby enhancing the disc holding capacity of the package 10. It will be understood that the front and rear sides may each be further adapted to accommodate more than one disc as described hereinbelow.

The package 10, if a hinged portion 16 is employed, may be manipulated into an open form (as shown in FIGS. 1 and 2), or into a compact form with adjacent sections 12 folded upon one another. In the compact form, the sections 12 of the package 10 may be folded at the hinge portions 16 to cause the front and rear sides thereof to abuttingly contact one another in juxtaposition to yield a stacked arrangement. The package 10 with the stacked arrangement of sections may thereafter be optionally packaged in a box or a wrap material such as cellophane. It will be understood that the package of the present invention may be folded in any configuration depending on the number of sections and the construction of the hinge portions of the package of the present invention.

It will be understood that although the present embodiment of the package 10 is shown having three sections successively connected to one another, the present invention is not limited to such arrangement, and may include other arrangements comprising two or more sections connected to one another.

As shown in FIGS. 1 and 2, each disc holding section 12 includes a front panel 18 and a rear panel 20 defining a disc storage area 26 therebetween. The front panel 18 and the rear panel 20, in combination, define a disc storage area 26 (see FIGS. 3A and 4) adapted for reversibly receiving a portion of at least one disc 14. One or more of the front and rear panels 18 and 20 may each include a disc receiving opening 22 and 24, respectively, in communication with the disc storage area 26 (as best shown in FIG. 4). The disc receiving openings 22 and 24 are each adapted for removably receiving a portion of the disc 14 therethrough, and may be suitably positioned on the front and rear panels 18 and 20, respectively, to securely retain a portion of the discs 14. It will be understood that the number, size and shape of the openings and the disc holding sections of the package of the present invention may be modified as necessary to accommodate a desired number or size of discs 14 for convenient packaging. For example, each section may include a single opening to accommodate one disc, opposed dual openings to accommodate two discs, or more than two openings to accommodate the corresponding number of discs as desired. Optionally, the surface of the front or rear panels 18 or 20 may be printed or applied with indicia to provide the package 10 with a visually attractive appearance or display.

In a preferred embodiment of the present invention, each disc holding section 12 may further comprise an intermediate panel 32 (as shown best in FIG. 4) occupying the disc storage area 26. The intermediate panel 32 partitions the disc storage area 26 to prevent contact between the discs 14 contained therein, and properly position the discs 14 within the respective areas of the disc storage area 26 as will be described hereinafter. The intermediate panel 32 further serves to reinforce the structural strength and integrity of the section 12 to minimize any bending or flexing of the discs 14 contained in the package 10.

Figure 3A:
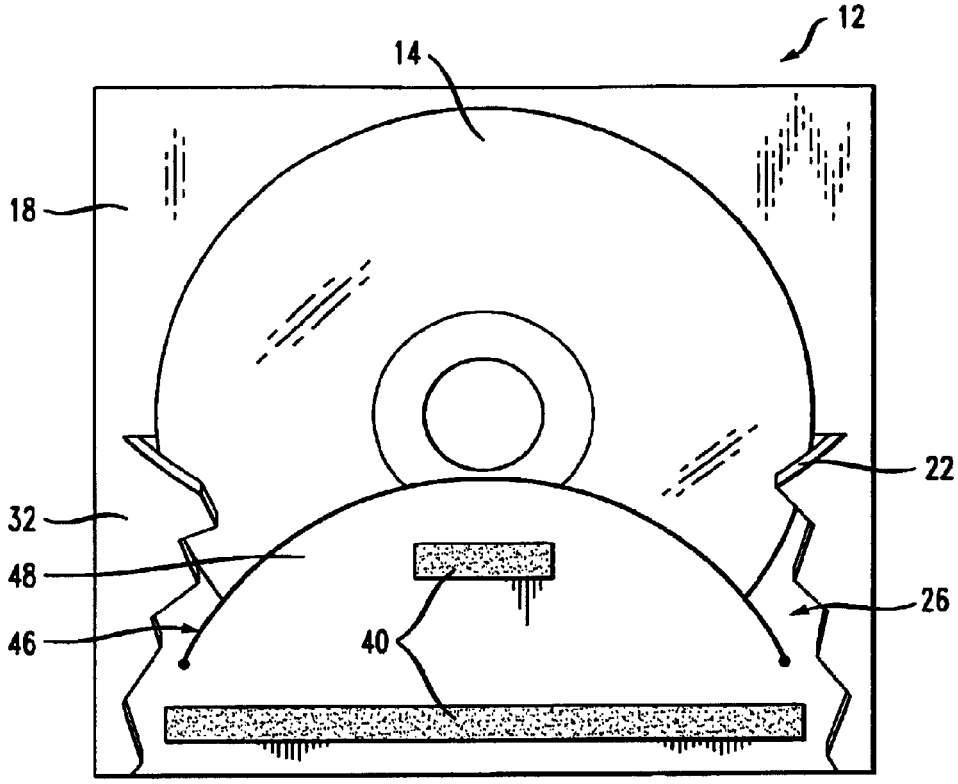
FIG. 3A is a front elevational view of a section of the package shown partially cut away with a disc retained therein.
Figure 4:
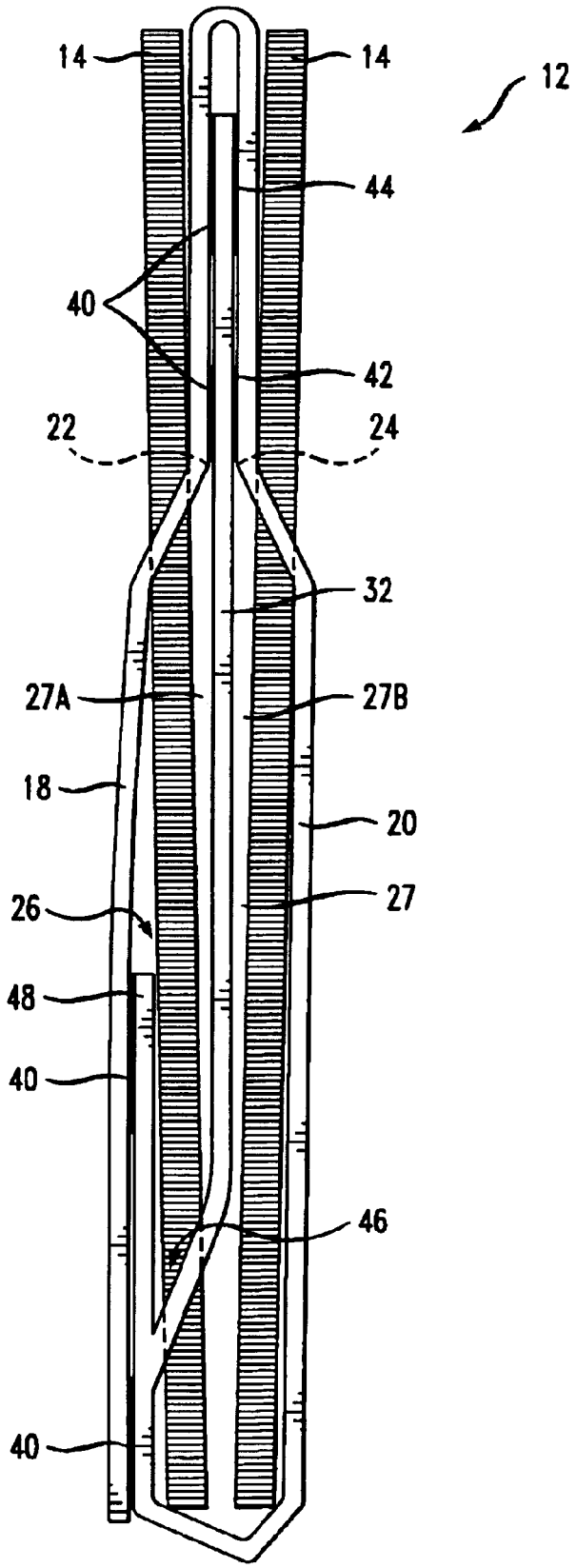
FIG. 4 is a side view of a section of the package of the present invention taken along view lines 4—4 of FIG. 1.

With reference to FIG. 3A, the section 12 of the package 10 is shown with a portion of the front panel 18 removed to illustrate the placement of a disc 14 through the opening 22 into the disc storage area 26 thereof. The intermediate panel 32 of the section 12 partitions the discs 14 from one another (as best shown in FIG. 4), to prevent the discs 14 from contacting one another when inserted through the openings 22 and 24 positioned in the front and rear panels 18 and 20, respectively. By preventing the discs 14 from contacting one another, abrasions, scratches or other surface damage to the discs 14 are prevented or at least minimized particularly at the point of entry through the openings 22 and 24. The intermediate panel 32, in cooperation with the front and rear panels 18 and 20, respectively, also maintains secure retainment of the discs 14 through frictional and mechanical pressure, and prevents the discs 14 from being inadvertently discharged from the openings 22 and 24.

In the preferred embodiment of the present invention, the intermediate panel 32 may further include a flap 48 (shown in FIG. 3A as having a semi-circular shape) that is partially frangible from the intermediate panel 32. The flap 48 may be secured to an inside surface of the front panel 18 (as shown best in FIG. 4) by an adhesive 40 or suitable fastening or connecting means. The flap 48, when partially separated from the intermediate panel 32, forms a slot 46 which permits the inserted portion of the disc 14 to bypass the adhesive 40 located between the intermediate panel 32 and the front panel 18, thus facilitating a deeper seating of the disc 14 within the disc storage area 26. In the absence of the flap 48 and the slot 46, the disc 14 would not be insertable through the opening 22 in the front panel 18 as the adhesive 40 would obstruct the passage of the disc 14 and repeated insertion of the disc 14 can cause the front panel 18 to separate from the intermediate panel 32 at the adhesives 40 resulting in the failure of the package 10.

Figure 3B:
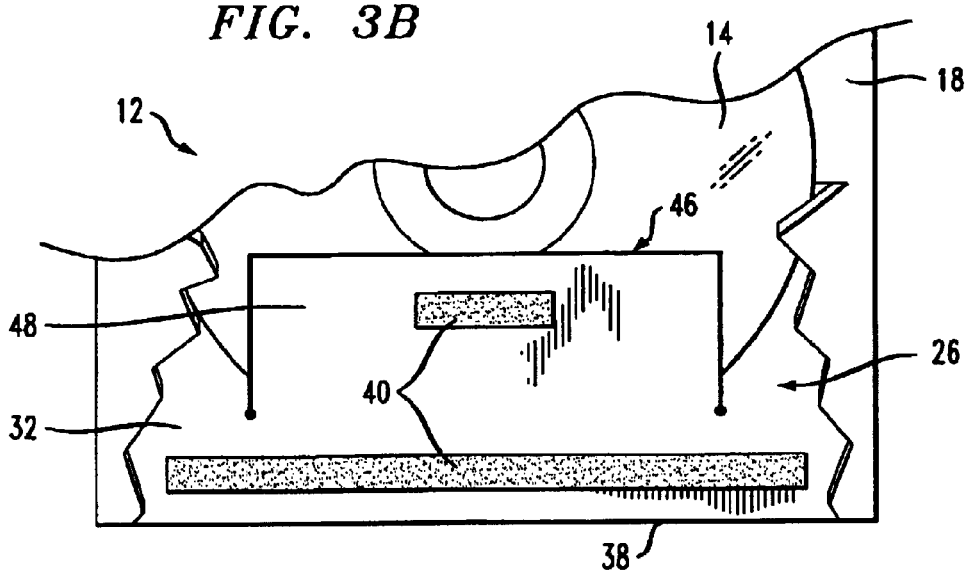
FIG. 3B is a front elevational view of a section of the package shown partially cut away with a disc retained therein for another embodiment of the present invention.

It will be understood that the size and shape of the flap 48 of the intermediate panel is not limited to that shown in FIG. 3A and may include other shapes including, but not limited to, triangles, rectangles (as specifically shown in FIG. 3B), polygonal shapes and the like.

With reference to FIG. 4, an exploded side view of the section 12 of the package of the present invention is shown to illustrate the arrangement of the discs 14 contained therein. The section 12 is shown in a laterally expanded state to show in better detail the respective components of the present invention. The components forming the section 12 are held together by the use of suitable fastening or connecting means including adhesives or mechanical fasteners, for example, as will be described hereinafter. The front and rear panels 18 and 20 are foldably arranged against one another with the intermediate panel 32 foldably arranged therebetween. The components are held together by adhesives 40, 42 and 44, respectively. In particular, the front panel 18 is secured to the intermediate panel 32 by adhesives 40 at the upper and lower ends of the section 12, and the rear panel 20 is secured to the intermediate panel 32 by adhesives 42 and 44 at the upper end of the section 12 to yield an integral and relatively rigid and compact structure.

As described above, the front and rear panels 18 and 20 may include openings 22 and 24, respectively, for permitting passage of a portion of the discs 14 into the disc storage area 26. The intermediate panel 32 prevents the discs 14 from contacting one another as one or both of the discs 14 are inserted through the respective openings 22 and 24 into the disc storage area 26, while enhancing the structural rigidity of the section 12. The intermediate panel 32 divides the disc holding disc storage area into a first disc holding space 27A in communication with the opening 22, and a second disc holding space 27B in communication with the opening 24. The flap 48 of the intermediate panel 32 provides a surface area for facilitating securement between the front and intermediate panels 18 and 32 via adhesives 40, and permits the disc 14 to bypass the joined portions of the front and intermediate panels 32, thereby allowing the disc 14 to be seated more deeply within the disc storage area 26.

The disc 14 inserted through the opening 22 passes through the disc holding space 27A into the slot 46 between the flap 48 of the intermediate panel 32 and the upper part of the intermediate panel 32, and bypasses the adhesives 40 securing the front panel 18 to the intermediate panel 32. The disc 14 inserted through the opening 24 passes into the disc holding space 27B of the disc storage area 26.

Figure 5A:
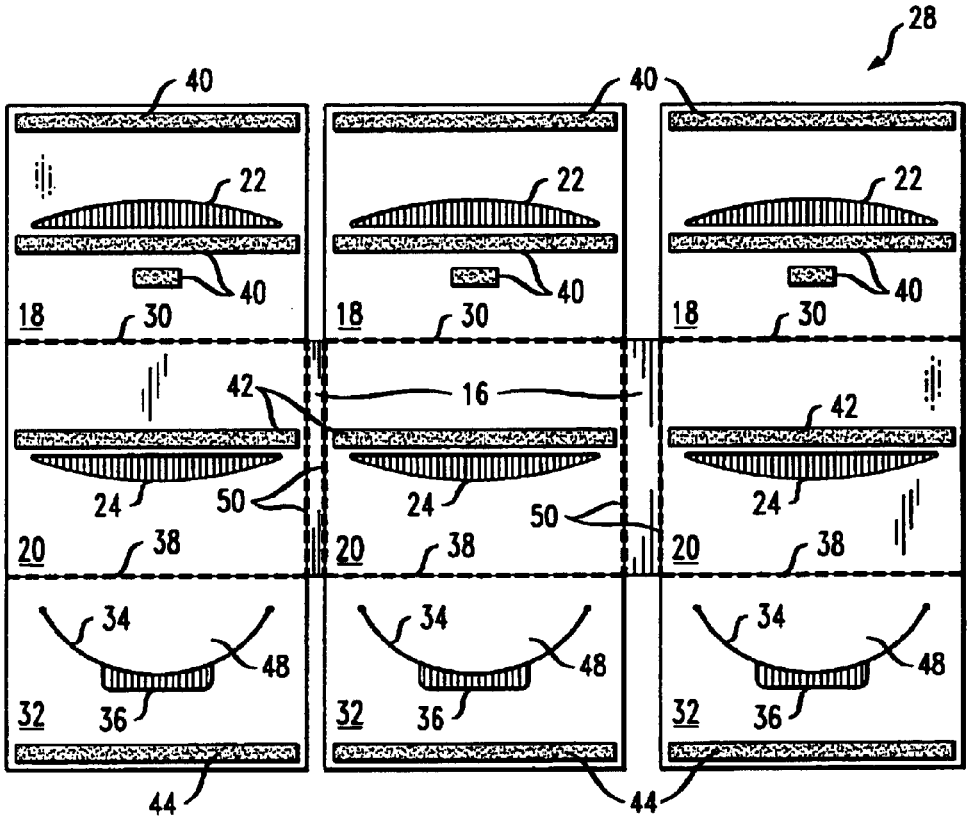
FIG. 5A is an elevational view of a blank for forming the package of FIG. 1 in accordance with the present invention.

With reference to FIG. 5A, a unitary blank 28 from which the package 10 is formed is shown for one embodiment of the present invention. The blank 28 comprises three rear panels 20 foldably attached to each other by the respective hinge portions 16 along respective fold lines 50; three front panels 18 each foldably connected to the respective rear panels 20 along respective fold lines 30; and three intermediate panels 32 each foldably connected to the respective rear panels 20 along fold lines 38. Each of the front panels 18, rear panels 20 and intermediate panels 32 that are immediately connected to another, in combination, form an individual section 12 of the package 10 as will be described herein. It will be understood that the blank 28 may be modified to vary the number of the connected front, rear and intermediate panels to form the desired number of sections in the package of the present invention.

Each of the front panels 18 optionally includes the disc receiving opening 22, each of the rear panels 20 optionally includes the disc receiving opening 24, and each of the intermediate panels 32 includes a frangible score line 34 and a slot 36. In the package 10 formed form the blank 28, the score line 34 of the intermediate panels 32 is adapted to perforate to form a flap 48 and a slot 46. The slot 36 of the blank 28 is adapted to permit an edge portion of the disc 14 to pass therethrough to begin perforation of the frangible score line 34 and separate the flap 48 from the intermediate panel 32 as the disc 14 is inserted through the opening 22. It will be understood that the shape the flap 48 is not limited to that shown, and can be modified to include other shapes as previously described.

It will be further understood that the blank 28 may be formed from a unitary rigid, foldable sheet material. Each of the frangible score lines 34, cutouts for the openings 22, 24, and 36 and fold lines 30, 38, and 50 are all preferably stamped or otherwise cut from the blank 28 using conventional blank making techniques known in the art.

Adhesive may be applied to the blank 28 at areas 40, 42, 44 indicated for fastening and maintaining the structure of the package 10. The blank 28 is folded and adhered together to the form the package 10 as will be described herein. Alternatively, the package 10 may be folded and fastened together by suitable mechanical fasteners such as, for example, staples as known in the art.

Figure 5B:
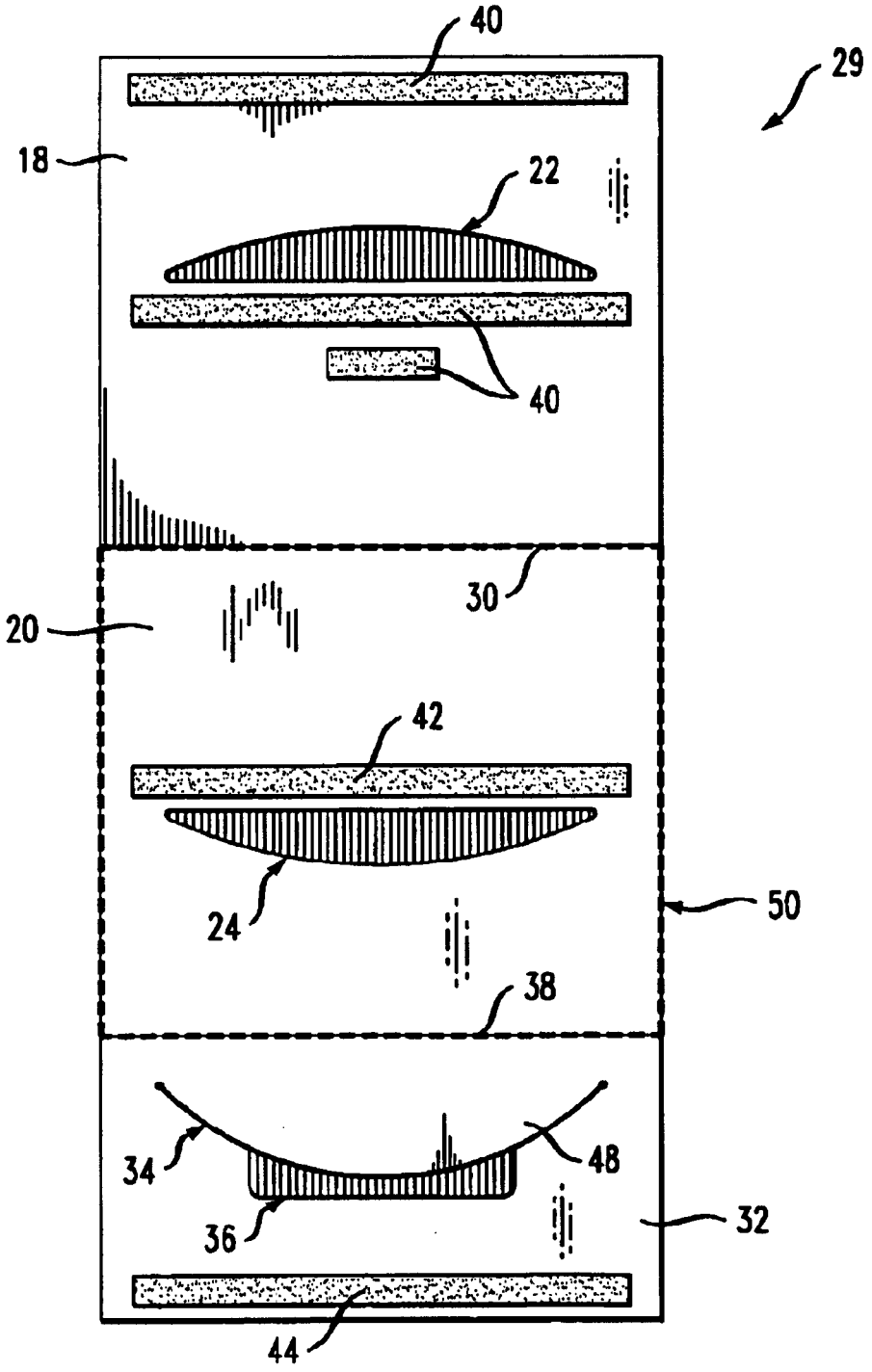
FIG. 5B is an elevational view of a portion of the blank of FIG. 5A for forming a section of the package in accordance with the present invention.

A portion 29 of the blank 28 is shown in FIG. 5B to illustrate the basic components for forming the disc holding section 12 of the package 10. The section 12 of the package 10 may be readily formed from the blank portion 29 by folding the intermediate panel 32 onto the rear panel 20 where the adhesive 44 of the intermediate panel 32 contacts and adheres to a corresponding portion of the rear panel 20 and the adhesive 42 of the rear panel 20 contacts and adheres to a corresponding portion of the intermediate panel 32. The front panel 18 is then folded over onto the respective intermediate panel 32 where the adhesives 40 of the front panel 18 contact and adhere to the flap 48 and other corresponding portions of the intermediate panel 32. This folding operation may be repeated for each blank portion 29 for forming a section 12 of the package 10.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A package for storing discs comprising:

at least one section comprising a first panel and a second panel together forming a dual disc storage area, said first and second panels each including at least one disc receiving opening in communication with said dual disc storage area, said dual disc storage area comprising a first storage space between the second panel and an intermediate panel integral with the second panel at one end, and a second storage space formed between the first and a portion of the intermediate panel, said intermediate panel having a lower portion with a slot therein defined by a flap covering a portion of the disc when the disc is positioned in the slot.

2. The package of claim 1 wherein the first panel includes an end portion connected to the flap by a connecting means.

3. The package of claim 1 wherein the intermediate panel includes an opposed end connected to the first and second panels by a connecting means.

4. The package of claim 1 wherein the front panel is integral with the second panel at one end.

5. A package for storing discs comprising:

a plurality of sections operatively engaged to one another, each of said plurality of sections comprising a first panel and a second panel together forming a dual disc storage area, said first and second panels each including at least one disc receiving opening in communication with said dual disc storage area, said dual disc storage area comprising a first storage space between the second panel and an intermediate panel integral with the second panel at one end, and a second storage space formed between the first and a portion of the intermediate panel, said intermediate panel having a lower portion with a slot therein defined by a flap covering a portion of the disc when the disc is positioned in the slot.

6. The package of claim 5 wherein the first panel includes an end portion connected to the flap by a connecting means.

7. The package of claim 5 wherein the intermediate panel includes an opposed end connected to the first and second panels by a connecting means.

8. The package of claim 5 wherein the first panel is integral with the second panel at one end.

9. The package of claim 5 wherein the plurality of sections are connected in juxtaposition to one another.

10. The package of claim 9 wherein the plurality of sections are hingedly connected.

11. The package of claim 5 wherein the plurality of sections is three.

* * * * *